United States Patent [19]

Keshock

[11] 4,096,590

[45] Jun. 27, 1978

[54] COLLAPSIBLE HAT

[76] Inventor: Edward G. Keshock, 1625 Kingsway, Norfolk, Va. 24112

[21] Appl. No.: 697,708

[22] Filed: Jun. 21, 1976

[51] Int. Cl.[2] ..... A42B 1/20

[52] U.S. Cl. ..... 2/180; 2/177

[58] Field of Search ..... 2/175, 180, 177, 185 B, 2/198

[56] References Cited

U.S. PATENT DOCUMENTS

| | | | |
|---|---|---|---|
| 480,041 | 8/1892 | Schlesinger | 2/175 X |
| 2,437,525 | 3/1948 | Harvel | 2/175 |
| 2,879,518 | 3/1959 | Welton | 2/175 |

FOREIGN PATENT DOCUMENTS

| | | | |
|---|---|---|---|
| 852,401 | 9/1970 | Canada | 2/185 B |
| 433,835 | 8/1935 | United Kingdom | 2/177 |

*Primary Examiner*—Werner H. Schroeder

*Assistant Examiner*—Peter Nerbun

*Attorney, Agent, or Firm*—Watts, Hoffmann, Fisher & Heinke Co.

[57] ABSTRACT

A snap brim hat is disclosed which has a crown, a brim assembly and tie straps. The brim assembly is manipulable between a pair of stable configurations. The brim assembly defines a sinuously configured brim periphery and includes an annular brim member formed from a flexible fabric and a hoop-like brim spring member secured to the brim member periphery. The brim and spring members react against each other so that each is stressed by the other and the stresses are balanced when the brim assembly is in either of its stable configurations.

When not in use, the hat can be collapsed into three generally concentric adjacent circular spring coils, or loops, and inserted into a suitable carrying container.

4 Claims, 14 Drawing Figures

COLLAPSIBLE HAT

BACKGROUND OF THE INVENTION

1. Field of the Invention

This invention relates to hats and more particularly relates to hats having sinuously configured brims.

2. The Prior Art

Wide-brimmed hats having brims formed from flexible sheet material and a resilient hoop secured about the brim periphery have been proposed in the prior art (see, for example, U.S. Pat. Nos. 2,495,041 and 1,946,998). The prior art proposals have been such that the brim hoops have functioned essentially like a supporting frame for the sheet material. Thus the prior art hats have had brim configurations dictated by the unstressed shape of the brim hoop or by the shape of the brim hoop when lightly stressed by engagement of a strap under the wearer's chin.

SUMMARY OF THE INVENTION

The present invention provides a new and improved hat having a brim assembly which comprises a flexible brim member extending about a central axis and a brim spring which is engaged about an outer peripheral portion of the brim member and in which the brim and spring members resiliently stress each other so that the spring member is deformed to define a series of undulations extending axially from opposite sides of a plane which is transverse to the axis.

According to one preferred embodiment the brim member is formed by a sheet of "bidirectional" material, i.e., one whose tensile strength is at its maximum in first and second transverse directions. The brim spring member defines first and second pairs of diametrically spaced locations, each pair aligned with a respective material direction. The brim spring is resiliently stressed into a sinuous shape so that the pairs of locations are displaced axially from each other in each stable configuration and the brim can be snapped between stable configurations.

Other features and advantages of the invention will become apparent from the following detailed description of the preferred embodiment made with reference to the accompanying drawings which form a part of the specification.

DESCRIPTION OF THE PREFERRED EMBODIMENT

Figure 1:
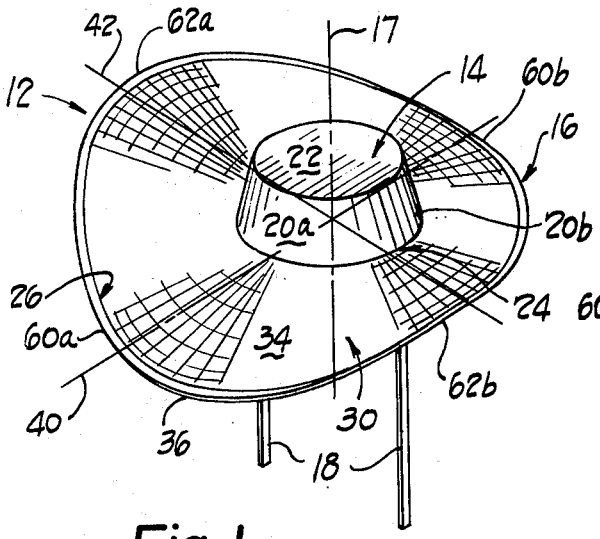
FIG. 1 is a perspective view of a hat embodying the invention with its brim assembly flexed to one of two stable configurations.
Figure 2:
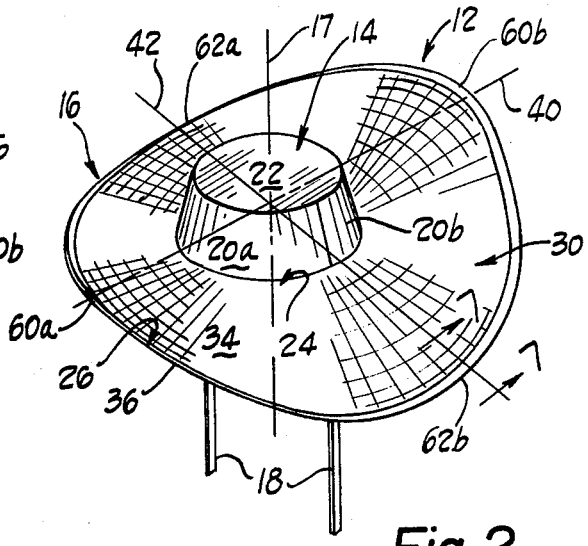
FIG. 2 is a perspective view of the hat illustrated in FIG. 1 with the brim assembly flexed to the alternate stable configuration.

A hat 12 embodying the present invention is shown in perspective in FIGS. 1 and 2 of the drawings and includes a crown 14, a sinuously configured brim assembly 16 extending outwardly from the crown 14 and arcuately about a central axis 17 and tie straps 18 depending from the brim assembly 16 which enable the hat 12 to be secured to a wearer's head.

The crown 14 is a cap-like structure formed by a pair of side panels **20*a*, 20*b* and a circular top panel 22. The crown panels are suitably attached to each other and secured to an inner peripheral portion 24 of the brim assembly 16**. The illustrated crown panels are formed by a thin supple flexible nylon fabric and are sewn to each other and to the brim assembly periphery. Other crown constructions can be used in place of that which is illustrated and described or the crown might be omitted entirely if that is desirable.

The ties 18 are formed by fabric strips, or tubes, which are sewn to the inner peripheral portion 24 of the brim assembly and to the crown 14 at diametrically spaced locations. The ties 18 are preferably constructed from the same material as the crown, but, like the crown, the ties need not be formed of any particular material.

The brim assembly 16 has a sinuous outer peripheral portion 26 which extends arcuately about the central axis 17. In a preferred and illustrated embodiment, the brim assembly 16 is formed by a flexible supple brim member 30 and brim spring member 32 (see FIG. 7) which is disposed circumferentially about the brim member. The spring and brim members react against each other so that each member is resiliently stressed by the other, and the brim assembly is maintained in a desired configuration by the mutually stressed members.

The brim member 30 is formed by a brim panel 34 and a spring tube or channel 36. The preferred and illustrated brim panel 34 is, prior to assembly in the hat, a generally circularly curved annular cloth panel. The brim panel 34 extends annularly about the central axis 17 with the inner periphery of the panel 34 forming the inner peripheral portion 24 of the brim assembly and the outer periphery of the panel 34 extending along the outer peripheral portion 26 of the brim assembly. The panel 34 is formed by a bidirectional sheet-like material, i.e., a material which has its maximum tensile strength in the plane of the material and in two directions normal to each other. These directions, in the preferred embodiment, extend fore and aft of the hat (as illustrated by the line 40 in FIGS. 1 and 2) and laterally relative to the hat (as indicated by the line 42 in FIGS. 1 and 2). The material forming the brim panel 34 thus produces a maximum tensile strength and resistance to stretching in the directions of the lines 40, 42 as viewed in FIGS. 1 and 2. The preferred brim panel 34 is formed from a lightweight nylon fabric (like the crown 14 and the ties 18) which is cross-woven so that the threads (see FIG. **10*a*) of the brim panel fabric, referred to as the warp and the weft of the fabric, extend in the directions of the line 40 (warp), and the line 42** (weft).

Figure 10:
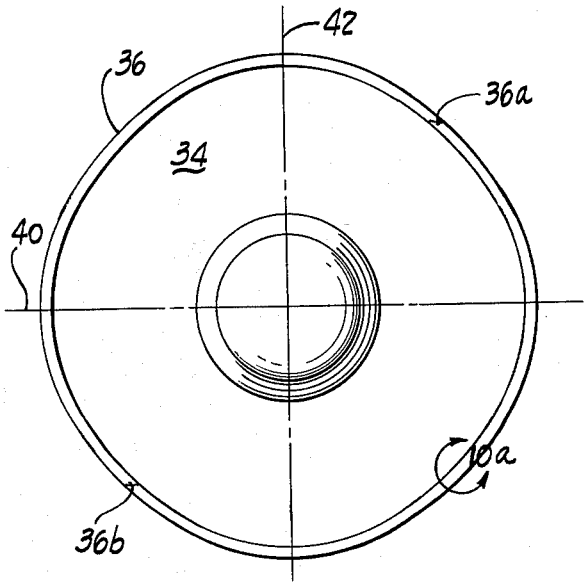
FIG. 10 is a view seen approximately from the plane indicated by the line 10—10 of FIG. 3.

The spring tube 36 is formed by a circumferentially expansible member which is attached about the outer periphery of the panel 34 and defines an internal passage 44 (see FIG. 7) within which the brim spring member 32 is positioned. The tube 36 is preferably formed from two semicircular fabric tube sections sewn together at their ends and stitched to the outer peripheral brim portion 26. The tube 36 may be formed from the above-mentioned nylon fabric with each tube section cut on the bias to enable circumferential tube expansion. The tube end sections are indicated by the reference characters 36*a*, 36*b* of FIG. 10.

Figure 7:
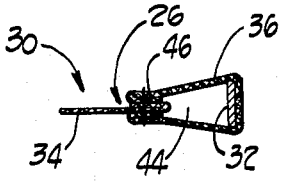
FIG. 7 is a cross-section view seen approximately from the plane indicated by the line 7—7 of FIG. 2.

FIG. 7 illustrates the interconnection of the brim panel 34 and the spring tube 36 by stitching indicated by the reference character 46. In the construction illustrated by FIG. 7 the cross-sectional thickness of the brim panel and spring tube fabrics are exaggerated for clarity.

Figure 8:
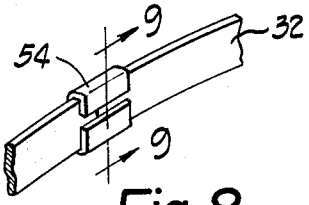
FIG. 8 is a perspective view of a portion of the brim assembly.
Figure 9:
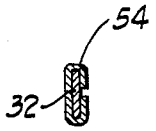
FIG. 9 is a cross-sectional view seen approximately from the plane indicated by the line 9—9 of FIG. 8.

The brim spring member 32 is formed by a thin hoop of resilient material which extends continuously about the outer peripheral portion 26 at the brim assembly in the passage 44. The circumferential length of the brim spring member, before assembly in the hat, exceeds the maximum length of the passage 44. When the brim and spring members are assembled, the spring tube 36 is circumferentially expanded to the length of the brim spring member and the brim panel 34 is thus radially tensioned as well as being circumferentially tensioned along its juncture with the spring tube. A preferred brim spring member 32 (illustrated by FIGS. 7–9) is formed by an elongated, thin, straight strip 50 of spring steel having its ends anchored adjacent each other by a metal clasp 54 (see FIGS. 8 and 9) to form a substantially circular flat annulus when not subject to external forces. The clasp 54 is crimped in place to lock the spring ends against relative movement.

Figure 10A:
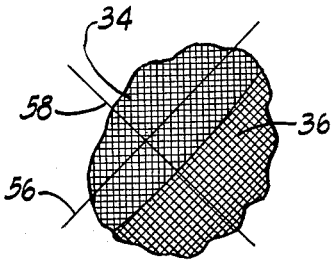
FIG. 10*a* is a view taken within the line 10*a* of FIG. 10, but on a greatly enlarged scale.

When the spring member is placed in the passage 44 the tube 36 is stretched to accommodate the spring length. With the spring and brim members assembled as described, the brim panel 34 is tensioned in the directions of the fabric warp and weft indicated by the lines 40, 42 (see FIGS. 10 and 10*a*). The panel 34 has its maximum tensile strength in these directions and thus resists any stretching in those directions. The panel is relatively free to stretch, somewhat resiliently, in the directions of the fabric bias (between the weft and warp directions) indicated by the lines 56, 58 of FIG. 10*a*. When the brim assembly is completed diametrically spaced brim locations, indicated by the reference characters 60*a*, 60*b* and 62*a*, 62*b*, which are aligned with the warp and weft of the brim panel fabric, are displaced axially on opposite sides, respectively, of a plane 64 (see FIGS. 1–6) extending transverse to the axis 17. The pairs of locations 60*a*, 60*b* and 62*a*, 62*b* are located at the front and rear and opposite lateral sides, respectively, of the hat and are intersected by the lines 40, 42. The plane 64 is the plane in which the annular brim spring member 32 would lie were the spring member not deformed by its interaction with the brim member 30.

It is believed the locations 60*a*, 60*b* and 62*a*, 62*b* are displaced axially from each other because these locations are engaged by the brim panel periphery portions which exhibit the maximum resistance to radial and circumferential stretching. By the same token the portions of the brim periphery intermediate the axially displaced portions are relatively free to expand circumferentially with the spring tube 36 to accommodate the length of the spring member. The result of the assembly, as illustrated by FIGS. 1–6, is a hat having an outer peripheral brim portion which is sinuous and undulates proceeding around the brim. The stresses in the brim spring member are balanced by stresses in the brim panel 34 so that the undulating form of the brim assembly is stably maintained by the brim and brim spring members reacting against each other.

The brim member 30, after being stretched to its assembled configuration would have a rounded corner square configuration if it could be flattened into the plane 64. The rounded "corner" portions of the square correspond to the brim portions 60*a*, 60*b* and 62*a*, 62*b* while the "sides" of the square correspond to the circumferentially stretched brim periphery sections.

Figure 3:
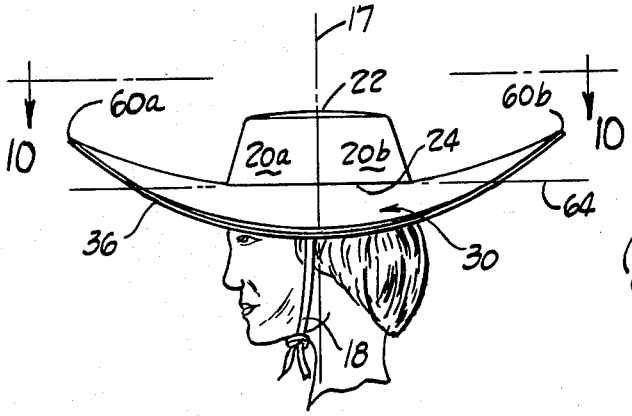
FIG. 3 is a side elevation view of the hat of FIG. 2.
Figure 4:
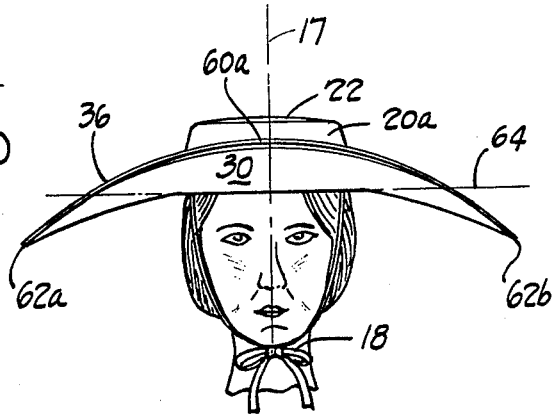
FIG. 4 is a front elevation view of the hat of FIG. 2.
Figure 5:
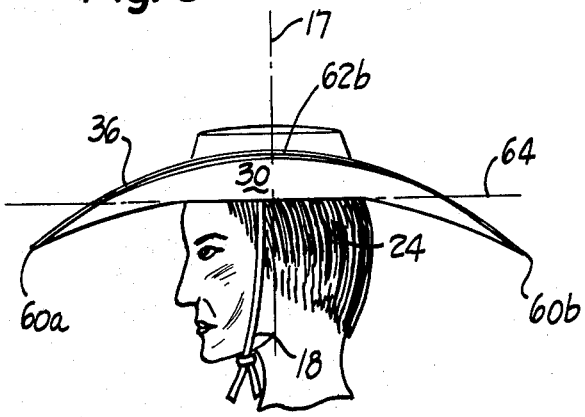
FIG. 5 is a side elevation view of the hat of FIG. 1.
Figure 6:
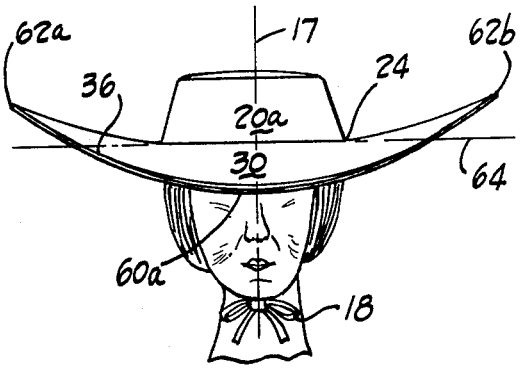
FIG. 6 is a front elevation view of the hat of FIG. 1.
Figure 11A:
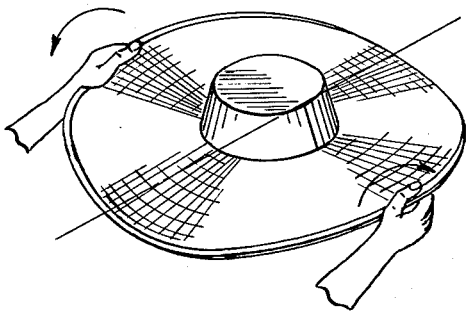
FIG. 11*a* is a perspective view showing the hat brim assembly being shifted between its stable configurations.

As illustrated by FIGS. 1–6, the brim configuration of the hat 12 is "bistable" in that the brim can be snapped between alternate stable brim configurations. FIGS. 1, 5 and 6 illustrating the hat 12 in an "early west" configuration with the brim assembly portions 60*a*, 60*b* at the front and rear of the hat extending below the plane 64 while the lateral brim portions 62*a*, 62*b* extend above the plane 64. FIGS. 2, 3, and 4 illustrate the hat 12 in a "Gaucho" configuration in which the brim portions 60*a*, 60*b* extend above the plane 64, while the lateral portions 62*a*, 62*b* extend below the plane 64. The brim assembly is manually snapped between its alternate configurations merely by grasping the outer peripheral portion of the brim assembly and twisting the hands oppositely, as illustrated by FIG. 11*a*.

Figure 11B:
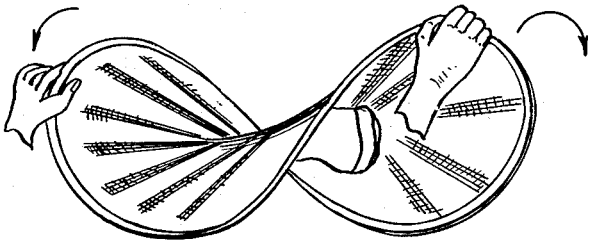
FIG. 11*b* is a perspective view of the hat being collapsed for storage.
Figure 12:
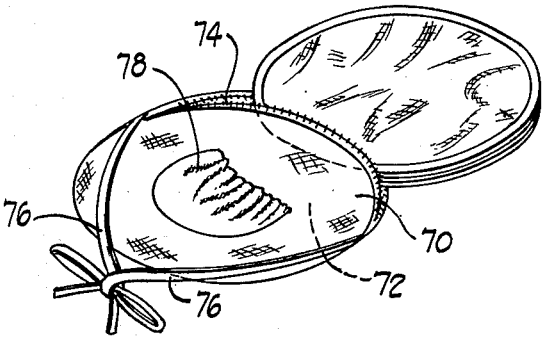
FIG. 12 is a perspective view of a pouch, or carrying case, receiving a collapsed hat.

The hat 12 can be collapsed for storage by twisting the brim assembly 16 so that the brim spring 32 is resiliently deformed into three overlying coils. An initial stage of twisting the brim assembly to collapse is illustrated by FIG. 11*b* while FIG. 12 shows the hat in its collapsed condition with the brim spring member formed into the overlying generally concentric coils. Once the hat 12 is coiled it may be conveniently inserted into a carrying pouch, see FIG. 12. The preferred pouch is formed from the nylon material from which the hat 12 is formed and consists of two circular panels 70, 72 which are sewn together partly around their periphery. The remaining peripheral portions of the panels 70, 72 around their periphery. The remaining peripheral portions of the panels 70, 72 are provided with a zipper-type closure 74. The pouch is provided with suitable carrying straps 76 and has a pocket 78 formed on one side.

In an alternative embodiment, a fabric whose weave is relatively unyielding along the bias direction (compared to the nylon) fabric referred to above can be employed as a brim material if the cloth is appropriately cut. For example, should a less yielding material, such as denim, be employed the brim material should be cut in a rounded square shape which closely approaches the circular shape used for the nylon fabric referred to above.

While various embodiments of the invention have been illustrated and described in considerable detail, the invention is not to be considered limited to the precise conceptions shown. Various adaptations, modification and uses of the invention may occur to those having ordinary skill in the art to which the invention relates, and the intention is to cover all such adaptations, modifications and uses which come within the scope or spirit of the appended claims.

What is claimed is:

1. A hat having a snap brim assembly which is adjustable between two stable brim configurations, the brim assembly comprising a generally annular brim member and a spring member disposed circumferentially about a brim member and extending generally annularly about an axis, said brim member formed from a sheet of flexible bi-directional material whose tensile strength is maximum in first and second transverse directions and less than maximum in other directions, said spring member having a planar configuration prior to assembly with said brim member, said spring member having a circumferential length in excess of the unstressed circumferential length of said annular brim member, said members engaged and reacting with each other so that said spring member is resiliently deformed to one of two stable nonplanar configurations, one configuration characterized by a first pair of diametrical spring member locations aligned in one of said transverse directions and being displaced in a first axial direction from their planar configuration locations and a second pair of diametrical spring member locations aligned in the other transverse direction and being displaced from their planar configuration locations in a second axial direction opposite to said first axial direction, the other configuration characterized by each of said diametrical spring member locations being displaced from their planar configuration locations in the opposite direction from their first configuration displacements, said brim member being resiliently tensioned radially and circumferentially along its juncture with said spring member to maintain said spring member in each of said two nonplanar configurations.

2. The hat claimed in claim 1 where said brim material has an unstressed circumferential length which is about three percent shorter than the spring member length.

3. A hat claimed in claim 1 wherein said spring member has a rectangular cross-sectional shape.

4. A hat having a snap brim assembly including a brim member defining an arcuate outer peripheral portion extending about a central axis and a ring-like brim spring member engaged with said brim member along said outer peripheral portion, the circumferential extent of said brim spring member exceeding the circumference of said brim member outer peripheral portion prior to assembly of said members and said brim member periphery resiliently expanded by said spring member upon assembly of said members, said brim member formed by a sheet of flexible bi-directional material whose tensile strength is maximum in first and second transverse directions and less than maximum in other directions, said brim spring member defining first and second pairs of diametrically spaced locations, the locations of each said pair aligned in one of said directions, resilient expansion of said brim member periphery by said spring member causing said brim member to be resiliently tensioned radially and circumferentially along its juncture with said spring member, said first pair of locations being displaced axially from one side of a plane extending transverse to said axis and said second pair of locations being displaced from the opposite side of said plane.

* * * * *